US008228053B2

(12) United States Patent
Stellberger et al.

(10) Patent No.: US 8,228,053 B2
(45) Date of Patent: Jul. 24, 2012

(54) STARTUP CIRCUIT FOR BANDGAP VOLTAGE REFERENCE GENERATORS

(75) Inventors: Achim Stellberger, Kronau (DE); Frank Schwiderski, Heidelberg (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 412 days.

(21) Appl. No.: 12/459,815

(22) Filed: Jul. 8, 2009

(65) Prior Publication Data

US 2011/0006749 A1 Jan. 13, 2011

(30) Foreign Application Priority Data

Jul. 8, 2009 (EP) ..... 09368024

(51) Int. Cl.
*G05F 3/16* (2006.01)

(52) U.S. Cl. ..... 323/313; 323/315

(58) Field of Classification Search ..... 323/313, 323/315–317; 327/538, 539
See application file for complete search history.

(56) References Cited

U.S. PATENT DOCUMENTS

| | | | | |
|---|---|---|---|---|
| 5,087,830 | A * | 2/1992 | Cave et al. | 327/539 |
| 5,867,013 | A | 2/1999 | Yu | |
| 6,084,388 | A * | 7/2000 | Toosky | 323/313 |
| 6,392,470 | B1 | 5/2002 | Burstein et al. | |
| 6,784,652 | B1 | 8/2004 | Aude | |
| 6,906,581 | B2 * | 6/2005 | Kang et al. | 327/539 |
| 6,972,550 | B2 | 12/2005 | Hong | |
| 7,286,002 | B1 | 10/2007 | Jackson | |
| 7,323,856 | B2 * | 1/2008 | Rabeyrin et al. | 323/313 |
| 7,911,195 | B2 * | 3/2011 | Draxelmayr | 323/313 |
| 2007/0182479 | A1 | 8/2007 | Kim | |
| 2008/0018317 | A1 | 1/2008 | Chen et al. | |

FOREIGN PATENT DOCUMENTS

| | | |
|---|---|---|
| EP | 09368024.7-1239 | 11/2009 |
| GB | 2 442 493 | 4/2008 |

OTHER PUBLICATIONS

European search report, GmbH.
"A CMOS Bandgap Reference Circuit with Sub-1-V Operation," by H. Banba et al., IEEE Journal of Solid-State Circuits, vol. 34, No. 5, May 1999, pp. 670-673.

* cited by examiner

*Primary Examiner* — Matthew Nguyen
(74) *Attorney, Agent, or Firm* — Saile Ackerman LLC; Stephen B. Ackerman

(57) ABSTRACT

Systems and methods to achieve a startup circuit of bandgap voltage reference generator circuits monitoring a current flow in the bandgap voltage reference generator circuit have been achieved. The startup circuit can operate at supply voltages of about one threshold voltage and is therefore appropriate for low voltage applications. The monitoring of a current through an electrical component inside the bandgap voltage reference generator circuit by replication the component branch in a scaled version saves power and does not disturb the normal operation of the current-mode bandgap voltage reference generator. The startup circuit invented can be applied for current-mode bandgap voltage reference generator circuits as well as for voltage-mode bandgap voltage reference generator circuits.

17 Claims, 4 Drawing Sheets

STARTUP CIRCUIT FOR BANDGAP VOLTAGE REFERENCE GENERATORS

BACKGROUND OF THE INVENTION (1) Field of the Invention

This invention relates generally to bandgap voltage reference generators and relates more specifically to a startup circuits for bandgap voltage reference generators.

(2) Description of the Prior Art

Typical bandgap voltage reference generator circuits are self-biased and have two stable bias-points, a desired operational bias point for which the circuit has been designed for and an undesired bias-point where the bandgap output voltage reference remains at 0 V. A dedicated startup circuit is required to ensure that the bandgap voltage reference generator is brought to an operating range where it can obtain the desired bias-point.

Current practice is to monitor a voltage inside the bandgap voltage reference generator and to initiate a current flow into the bandgap reference voltage generator circuit as long as the voltage monitored does not have the operation condition required. The disadvantage of monitoring a voltage is that the voltage monitoring is performed by a voltage comparator, which requires a specific voltage for its operation and a reference voltage.

It is a challenge for the designers of startup circuits for bandgap voltage reference generators to design a circuit wherein the startup condition is process independent because a threshold voltage of NMOS or PMOS devices is used as reference and wherein no reference voltage is required for the startup.

There are known patents or patent publications dealing with startup circuits for bandgap voltage reference generators.

(U.S. Pat. No. 6,972,550 to Hong proposes a bandgap voltage reference generator including a bandgap voltage reference circuit and a fast startup circuit. The fast start-up circuit, which is cost-efficient and saves power consumption, can rapidly start up the bandgap reference voltage circuit coupled thereto.

U.S. Patent Publication (US 2007/0241735 to Rabeyrin et al.) discloses a power efficient startup circuit for activating a bandgap reference circuit. The startup circuit uses a voltage supply having a voltage level to initiate the flow of a startup current used to activate the bandgap reference circuit.

U.S. Patent Publication (US 2008/0018317 to Chen et al.) describes a bandgap reference circuit having a low sensitivity to temperature and supplied voltage installs a compensation circuit on a bandgap reference circuit to substitute a prior art that uses a resistor to match the circuit startup purpose and solve the problem of startup error caused by the manufacturing error.

Furthermore there are two more patents dealing with startup circuits for bandgap voltage reference generators:

(U.S. Pat. No. 6,784,652 to Aude) describes a startup circuit for a bandgap voltage reference generator circuit. Monitoring an internal reference voltage of the bandgap voltage reference generator circuit, current flow for the bandgap circuit diodes is initiated following circuit startup, e.g., initial application or DC power (U.S. Pat. No. 6,784,652 to Yu) discloses a circuit including a band-gap reference circuit and a start-up circuit coupled between an output and an input of the band-gap reference circuit. When the output of the band-gap reference circuit is below a start-up voltage threshold, the start-up circuit provides a first voltage at the input of the band-gap reference circuit, which, in turn, causes the band-gap reference circuit to produce a desired voltage at the output.

SUMMARY OF THE INVENTION

A principal object of the present invention is to achieve methods and systems for a startup circuit of a bandgap voltage reference generator that monitors a current flow through a bandgap diode and therefore ensures that the bandgap voltage reference generator is in the correct operating range.

A further object of the invention is to achieve a startup circuit for a bandgap voltage reference generator, which does not require a reference voltage.

A further object of the invention is to achieve a startup circuit for a bandgap voltage reference generator that operates at supply voltages of about a transistor threshold voltage and is therefore appropriate for low voltages applications A further object of the invention is to achieve a startup circuit for a bandgap voltage reference generator wherein the behavior of the startup circuit is controlled by a current source.

A further object of the invention is to achieve a startup circuit for a bandgap voltage reference generator, wherein the current through an electrical component of the bandgap voltage reference generator is monitored by replicating the component branch in a scaled version to save power without disturbing the normal operation of the bandgap voltage reference generator.

Moreover another object of the invention is to achieve a bandgap voltage reference generator having a startup condition being independent of a semiconductor process used with the components.

In accordance with the objects of this invention a method for startup circuits of bandgap voltage reference generator circuits monitoring a current flow in the bandgap voltage reference generator circuit has been achieved. The method invented comprises, first, the following steps of: (1) providing a current-mode bandgap voltage reference generator circuit and a startup circuit comprising a current detection unit, (2) monitoring a current flow in the bandgap voltage reference generator circuits by the current detection circuit, and (3) injecting a startup current to the bandgap voltage reference generator circuit by the startup circuit as long as said current monitored is below a limit defined. Furthermore the method comprises the steps of (4) disengage functionally the startup circuit after said current monitored has reached said limit defined and the bandgap voltage reference generator circuit has reached its operating range, and (5) regulating, right after the bandgap voltage reference generator circuit has reached its operating range, an internal voltage of the bandgap voltage reference generator in order to reach the bias point desired of the bandgap voltage reference generator.

In accordance with the objects of this invention a startup circuit of bandgap voltage reference generator circuits monitoring a current flow in the bandgap voltage reference generator circuit has been disclosed. The startup circuit invented comprises, firstly, a first circuit branch, comprising a first transistor and a first diode, which has been replicated from a branch of the bandgap voltage reference generator circuit, wherein the current through said branch of the bandgap voltage reference generator circuit is mirrored to said first branch, and wherein said first branch is connected between Vdd voltage and ground, a current detection unit having inputs and an output, wherein a first input is a current through said first diode, a second input is a reference current, and the output is a voltage to a gate of second transistor initiating a startup current to the bandgap voltage reference generator circuit if said current of the first input is smaller than said reference current, and a second circuit branch comprising a current source, said second transistor and a current mirror configuration mirroring the current of the second circuit branch to a third circuit branch, wherein said second branch is connected between Vdd voltage and ground. Furthermore the startup circuit invented comprises said third branch comprising a transistor of said current mirror configuration connecting the second and the third branch wherein said third branch is connected between a gate of said first transistor and ground.

BRIEF DESCRIPTION OF THE DRAWINGS

In the accompanying drawings forming a material part of this description, there is shown.

DESCRIPTION OF THE PREFERRED EMBODIMENTS

Circuits and methods for a startup bandgap voltage reference generator are disclosed. Instead of monitoring a voltage as usually performed in prior art, the startup circuit of the present invention monitors a current flow in the bandgap voltage reference generator circuit. The startup circuit operates using supply voltages in the order of about a threshold voltage of a PMOS or NMOS device and is therefore appropriate for low voltage applications.

In addition the need for a voltage reference is removed. The advantage of this is that the startup condition is semiconductor process independent because in prior art often the threshold voltage of MOS devices is used as reference voltage.

Figure 1:
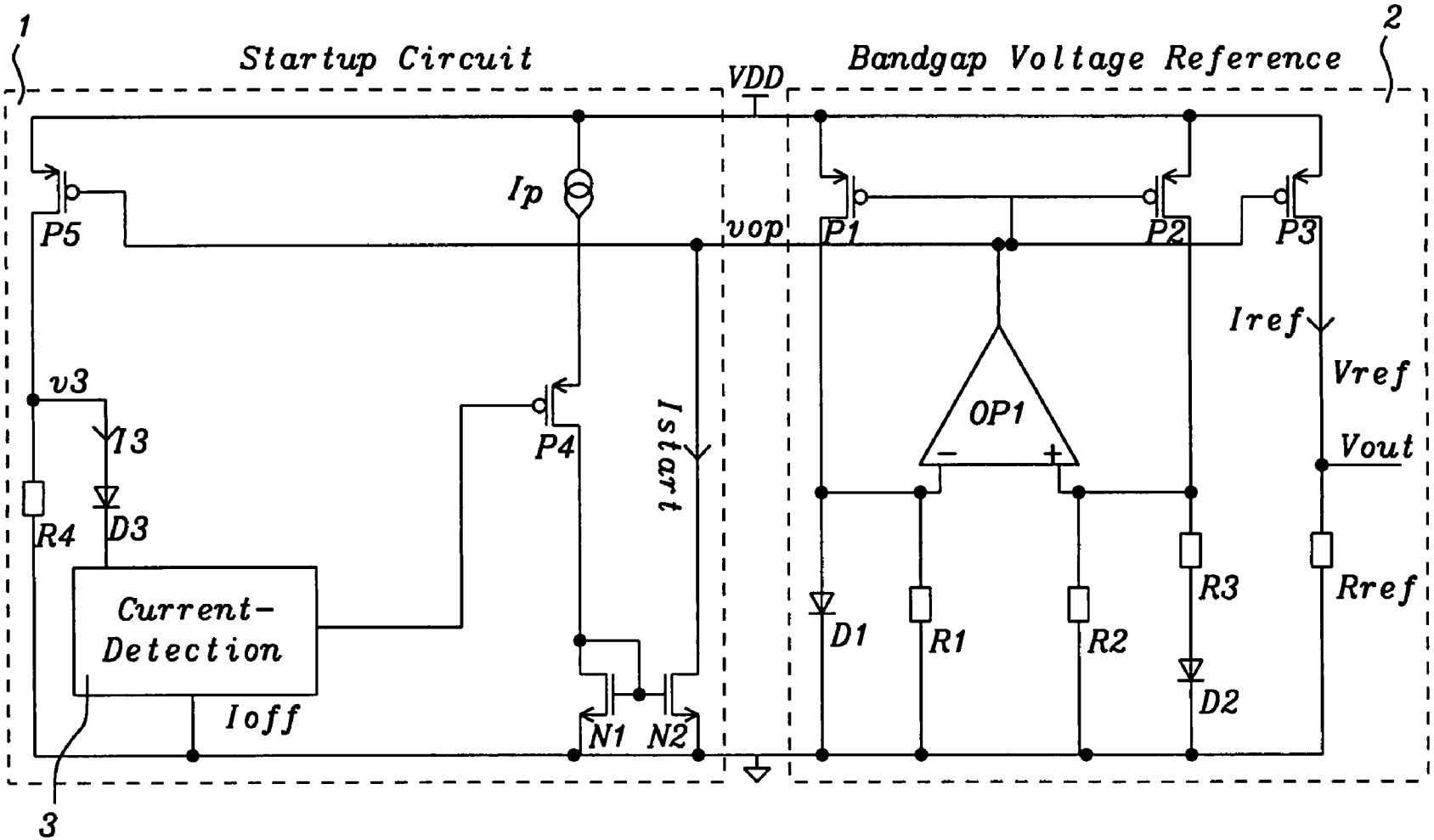
FIG. 1 illustrates a principal schematic of a current-mode bandgap voltage reference generator driven by startup circuit of the present invention.

FIG. 1 illustrates a principal schematic of a current-mode bandgap voltage reference generator driven by startup circuit of the present invention. The circuit of FIG. 1 has two parts, a startup circuit 1 invented and a current-mode bandgap voltage reference generator 2. It should be noted that the invention could be applied to voltage-mode bandgap voltage reference generators as well.

As it is well known, a bandgap voltage reference generator circuit provides an output voltage with a low sensitivity to temperature with the help of diodes. In a conventional bandgap voltage reference generator, the voltage is obtained as a sum of a voltage complementary to absolute temperature (CTAT) and a voltage, which is proportional to absolute temperature (PTAT). This yields to a reference voltage, which is approximately 1.2 V. Thus, the supply voltage must be somewhat higher than 1.2 V. For lower supply voltages a current-mode bandgap voltage reference generator can be used which sums up a CTAT and PTAT current rather than voltages and forces this current through a resistor.

The operational amplifier OP1 in the bandgap voltage reference generator 2 shown in FIG. 1 controls the currents through transistors P1 and P2 and hence the node voltages Vn and Vp.

Figure 2:
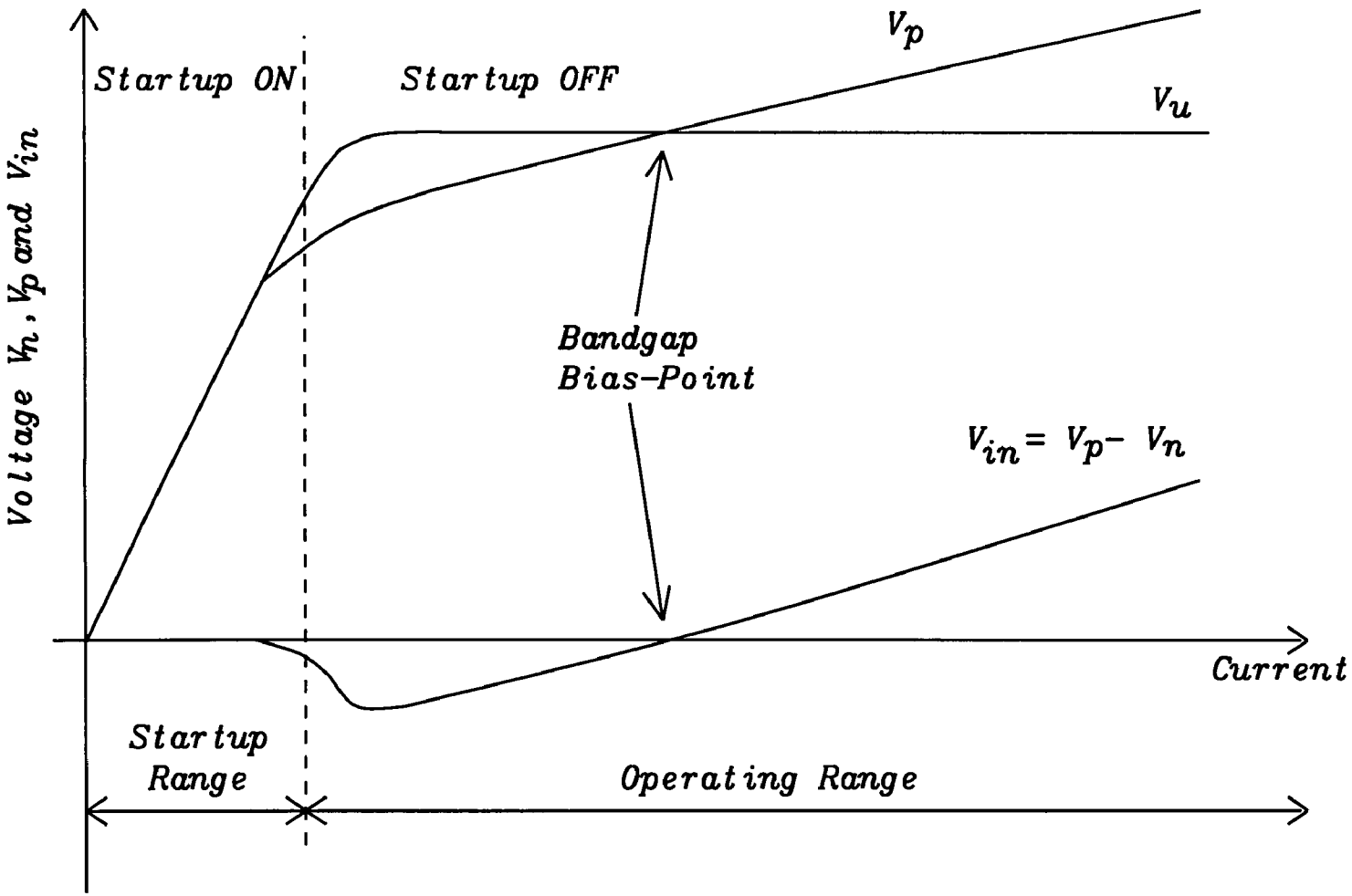
FIG. 2 shows principal voltage characteristics of the interaction between a bandgap voltage reference generator circuit and a startup circuit invented.

FIG. 2 shows the principal voltage characteristics of $V_n$, $V_p$ and the resulting differential input voltage $V_{in}=V_p-V_n$ of operational amplifier OP1 versus the current of transistors P1 and P2. The differential input voltage Vin of OP1 remains low as long as the voltage drops on the resistors R1 and R2 are below the forward voltage of diodes D1 and D2. This could cause the bandgap voltage reference generator circuit 2 to stay in a wrong stable bias point of OP1 has not enough gain or if OP1 has an offset voltage higher than $V_{in}$. The output port of the bandgap voltage reference generator circuit is signified by $V_{out}$.

If the diode forward voltage has been reached significant current is flowing into the diodes D1 and D2 producing an input voltage difference $V_{in}$ for OP1 because of their different size, which is allowing OP1 to bring up the bandgap voltage reference generator circuit to its correct bias-point. Therefore the basic idea of the startup circuit 1 is to monitor the current through the diode and to inject a startup current $I_{start}$ to the bandgap voltage reference generator 2 as long as the diode current is below a certain limit. This always brings the bandgap voltage reference generator 2 into operation with a sufficiently high input voltage $V_{in}$ and the bandgap voltage reference generator 2 circuit will reach its bias-point desired due to the regulation of OP1.

The monitoring of the diode current by the startup circuit is performed by using a scaled matching replication of the diode/resistor/transistor structure of diode D1, resistor R1, and transistor P1 of the bandgap voltage reference generator 2. This diode/resistor/transistor structure has been replicated in the startup circuit 1 to a matched diode/resistor/transistor structure of diode D3, resistor R4, and transistor P5.

It should be noted that another branch of the bandgap voltage reference generator, such as e.g. the branch comprising transistor P2, diode D2, and resistor R3 could be replicated alternatively as well. In the preferred embodiment the P1, D1, and R1 branch has been selected for replication because diode D1 is smaller than diode D2 and therefore current will flow through D2 before flowing through diode D1. For startup purposes it is thus better to use diode D1 for replication because it represents a "harder" condition.

The current detection circuit 3 detects if the current $I_3$ is lower than current $I_{off}$, which is another input to the current detection circuit 3. As long as the current $I_3$ is lower than the current $I_{off}$, the current detection circuit 3 turns on transistor P4 and enables the current $I_{start}$ to pull down the voltage at node $V_{op}$. Therefore transistors P1, P2, and P5 are on during the startup period and initiate a current flow. At first the current through transistor P5 is low and while voltage V3 is lower than the forward voltage of diode D3, most of the current through transistor P5 is flowing to the resistor R4. The current $I_3$ is then still lower than current $I_{off}$ and transistor P4 remains on and this causes current $I_{start}$ to pull the node voltage $V_{op}$ further down, forcing more current through transistor P5.

When the voltage drop on resistor R4 reaches the diode forward voltage of diode D3, the current $I_3$ increases and reaches current $I_{off}$. The current detection circuit 3 turns transistor P4 off, stopping to pull the voltage $V_{op}$ further down. Now, the startup circuit 1 has no influence on the bandgap voltage reference generator 2 anymore, i.e. the startup circuit is functionally disengaged. At this moment the bandgap voltage reference generator 2 is in the operating range (as shown in FIG. 2), because current is flowing through diodes D1 and D2 as well now. The operational amplifier OP1 regulates the voltage $V_{op}$ further down until the bandgap voltage reference generator 2 has reached its bias point desired.

Figure 3:
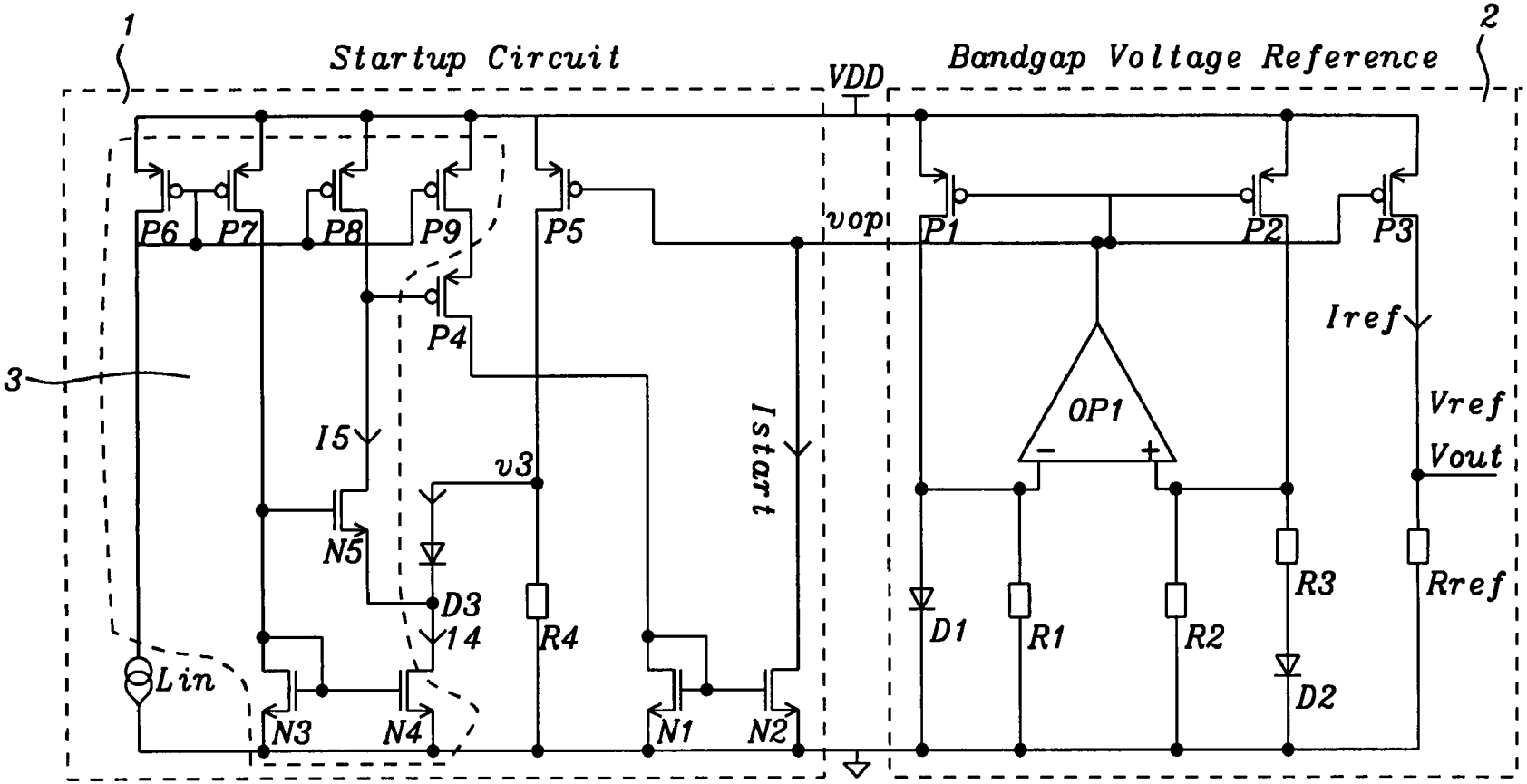
FIG. 3 shows a principal schema of a current-mode bandgap voltage reference generator driven by a startup circuit of the present invention including a more detailed implementation of the startup current detection.

An implementation of the current detection circuit is illustrated in FIG. 3. FIG. 3 shows a principal schematic of a current-mode bandgap voltage reference generator driven by a startup circuit of the present invention including a more detailed implementation of the startup current detection. A preferred embodiment of the current detection circuit implementation 3 is shown in FIG. 3 inside of the dotted line in the startup circuit 1.

First, when the startup of the bandgap voltage reference generator 2 begins, no current is flowing through transistors P2, P1, and P5, and the current $I_3$ through diode D3 is zero. A current $I_{in}$ is mirrored by transistors P7, P8, and P9. Transistor P7 is sourcing transistor N3, which means that transistors N4 and N5 are conductive.

The current capability of N5 is much higher than the current capability of transistor N4, i.e. transistor N5 can conduct a much higher current than transistor N4. Transistors N4 and N5 are able to sink more current than transistor P8 can provide, hence pulling the gate of transistor P4 to ground. In turn, this allows transistor N2 to pull down the node voltage $V_{op}$, hence initiating a current flow through transistors P2, P1, P3 and P5, thus injecting a startup current to the bandgap voltage reference generator 2. Other circuit designs than the preferred circuit to inject a startup current using a current source described above are possible as well.

Controlling the startup of the bandgap voltage reference generator behavior by a current source as $I_{in}$ shown in FIG. 3 avoids an overshoot of the output voltage of the bandgap voltage reference generator.

As long as current $I_5$ is higher than the current capability of transistor P8, the gate of transistor P4 is held at ground allowing the current through transistor P5 to increase during startup. The current $I_3$ increases after the node voltage V3 reaches the diode forward voltage of diode D3. Therefore the source voltage of transistor N5 increases, hence switching off transistor N5. The gate of transistor P4 is pulled up by transistor P8 that turns transistor N2 off. This means that no startup current is flowing to the bandgap voltage reference generator anymore. Now, the startup circuit 1 has no influence on the bandgap voltage reference generator 2, i.e. the startup circuit is functionally disengaged. Other circuit designs than the preferred circuit to compare a current in the bandgap voltage reference generator with a reference current and to stop the injection of a startup current if the current in the bandgap voltage reference generator has reached a current limit defined described above are possible as well.

The current detection circuit disclosed can operate well below 1 V supply voltage and is therefore suitable for low voltage applications. The current $I_{off}$ for the startup condition can be set well below the diode bias-current, which means that the bandgap voltage reference generator has a wide operating range. The startup circuit 1 operates as well for conventional bandgap voltage reference generators without resistors in parallel to the diodes. For those circuits resistor R4 in the startup circuit 1 can be removed as well.

The startup behavior of the bandgap reference circuit can be controlled by the current $I_{start}$, which is set by the current source transistor N2.

Figure 4:
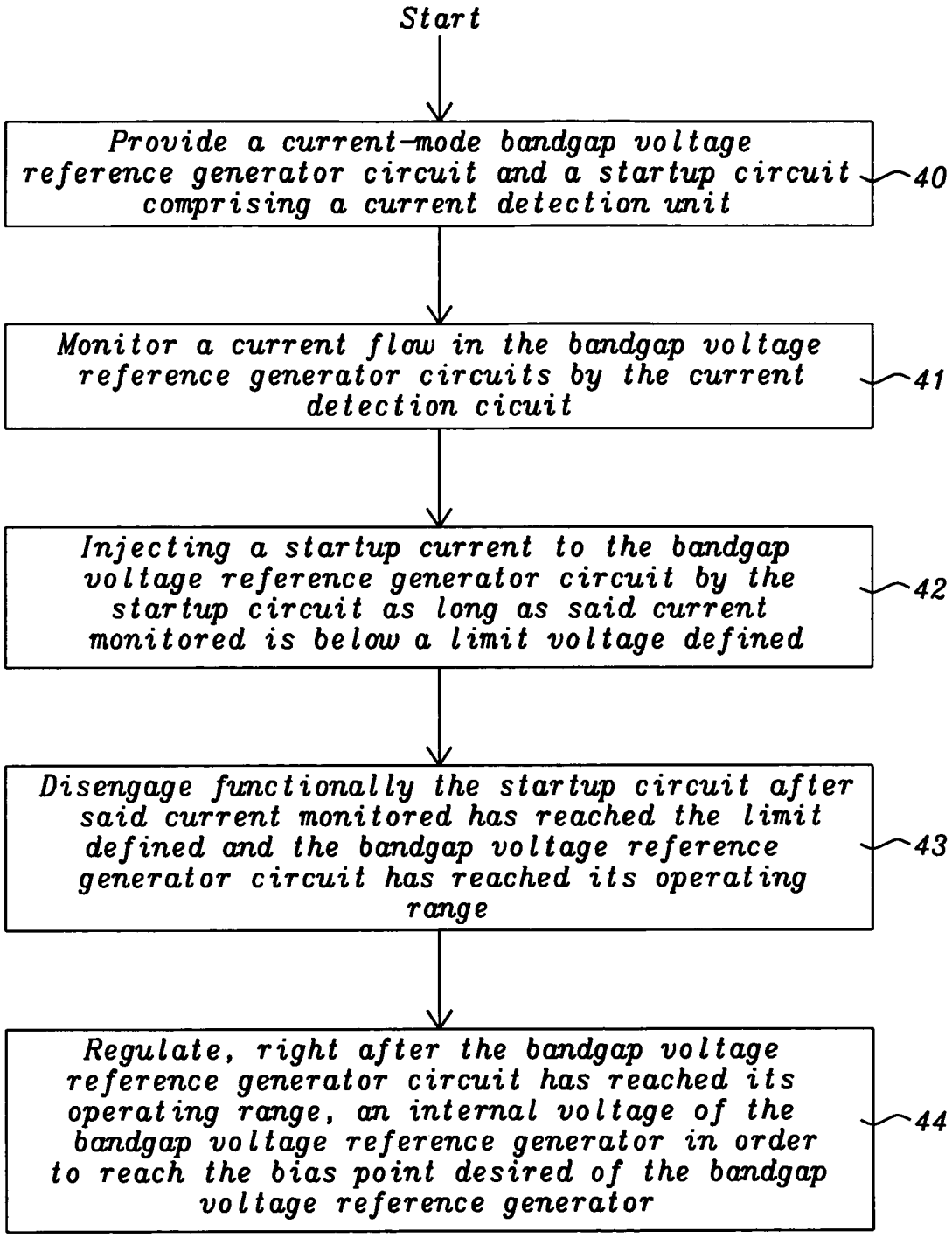
FIG. 4 illustrates a flowchart of a method invented for startup circuits of bandgap voltage reference generator circuits monitoring a current flow in the bandgap voltage reference generator circuit.

It should be noted again that the startup circuit of the present invention could be used with voltage-mode bandgap reference circuits as well, if the resistors R1, R2, and replicated resistor R4 as shown in FIG. 4 are omitted.

FIG. 4 illustrates a flowchart of a method invented for startup circuits of bandgap voltage reference generator circuits monitoring a current flow in the bandgap voltage reference generator circuit. A first step 40 describes the provision of a current-mode bandgap voltage reference generator circuit and a startup circuit comprising a current detection unit. A next step 41 illustrates monitoring a current flow in the bandgap voltage reference generator circuits by the current detection circuit. Step 42 describes injecting a startup current to the bandgap voltage reference generator circuit by the startup circuit as long as said current monitored is below a limit defined. Step 43 discloses the functionally disengagement of the startup circuit after said current monitored has reached the limit defined and the bandgap voltage reference generator circuit has reached its operating range.

Step 44 illustrates regulating, right after the bandgap voltage reference generator circuit has reached its operating range, an internal voltage of the bandgap voltage reference generator in order to reach the bias point desired of the bandgap voltage reference generator.

In summary, key items of the present invention are:

1. Instead of monitoring a voltage, the startup circuit invented monitors a current flow in the bandgap voltage reference generator circuit. The invention is not using a MOS threshold to accomplish a startup function.
2. Controlling the behavior of the startup circuit by a current source avoids an overshoot of the output voltage.
3. The invention allows a low voltage operation of the startup circuit.
4. A process independent startup condition has been achieved because no voltage reference is required.
5. The bandgap generator and the startup circuit invented can operate with supply voltages in the 1 V range.

While the invention has been particularly shown and described with reference to the preferred embodiments thereof, it will be understood by those skilled in the art that various changes in form and details may be made without departing from the spirit and scope of the invention.

What is claimed is:

1. A method for startup circuits of bandgap voltage reference generator circuits monitoring a current flow in the bandgap voltage reference generator circuit, comprising the following steps:

(1) providing a current-mode bandgap voltage reference generator circuit and a startup circuit comprising a current detection circuit;

(2) monitoring a current flow in the bandgap voltage reference generator circuits by the current detection circuit;

(3) injecting a startup current to the bandgap voltage reference generator circuit by the startup circuit as long as said current monitored is below a limit defined;

(4) disengage functionally the startup circuit after said current monitored has reached said limit defined and the bandgap voltage reference generator circuit has reached its operating range; and (5) regulating, right after the bandgap voltage reference generator circuit has reached its operating range, an internal voltage of the bandgap voltage reference generator in order to reach the bias point desired of the bandgap voltage reference generator.

2. The method of claim 1 wherein said monitoring of a current flow is performed by mirroring said current flow to the start-up circuit and by comparing the current mirrored with a reference current.

3. The method of claim 2 wherein said mirroring is performed by using a scaled matching replication of a branch of the bandgap voltage reference generator circuit in the startup circuit.

4. The method of claim 3 wherein said branch replicated comprises a transistor in series with a diode.

5. The method of claim 4 wherein said branch comprises a resistor in parallel to said diode.

6. The method of claim 4 wherein said branch replicated from the bandgap voltage reference generator circuit is a branch comprising a smallest diode of the bandgap voltage reference circuit.

7. The method of claim 1 wherein said injection of a startup current is controlled by the current detection circuit.

8. The method of claim 1 wherein said regulation of an internal voltage is performed by an operational amplifier.

9. The method of claim 1 wherein said bandgap voltage reference generator is a current-mode bandgap voltage reference generator.

10. The method of claim 1 wherein said bandgap voltage reference generator is a voltage-mode bandgap voltage reference generator.

11. A startup circuit for bandgap voltage reference generator circuits monitoring a current flow in the bandgap voltage reference generator circuit comprises:

a first circuit branch, comprising a first transistor and a first diode, which has been replicated from a branch of the bandgap voltage reference generator circuit, wherein the current through said branch of the bandgap voltage reference generator circuit is mirrored to said first branch, and wherein said first branch is connected between Vdd voltage and ground;

a current detection circuit having inputs and an output, wherein a first input is a current through said first diode, a second input is a reference current, and the output is a voltage to a gate of second transistor initiating a startup current to the bandgap voltage reference generator circuit if said current of the first input is smaller than said reference current;

a second circuit branch comprising a current source, said second transistor and a current mirror configuration mirroring the current of the second circuit branch to a third circuit branch, wherein said second branch is connected between Vdd voltage and ground; and said third circuit branch comprising a transistor of said current mirror configuration connecting the second and the third branch wherein said third branch is connected between a gate of said first transistor and ground, wherein a current generated in said third branch during start-up is injected to the bandgap voltage reference generator during startup phase.

12. The circuit of claim 11 wherein said replication from a branch of the bandgap voltage reference generator circuit is performed by a scaled matched replication.

13. The circuit of claim 12 wherein said branch replicated from the bandgap voltage reference generator circuit is a branch comprising a smallest diode of the bandgap voltage reference circuit.

14. The circuit of claim 11 wherein said current detection circuit comprises a means to inject a current to the bandgap voltage reference generator circuit if a current in the bandgap voltage reference generator circuit is lower than a current limit defined; and a means to compare a current of the bandgap voltage reference generator circuit with a reference current and to stop the injection of a startup current if a current in the bandgap voltage reference generator circuit has reached a current limit defined.

15. The circuit of claim 14 wherein said means to inject a current and said means to compare a current of the bandgap voltage reference generator circuit with a reference current and to stop the injection of a startup current comprise a fourth circuit branch, connected between Vdd voltage and ground, comprising a reference current source and a first transistor, wherein the current through said first transistor is mirrored to a first transistor of a fifth circuit branch, a first transistor of a sixth circuit branch and to a first transistor of a seventh circuit branch;

said fifth circuit branch, connected between Vdd voltage and ground, comprising said first transistor of the fifth branch connected to a gate of a second transistor of said sixth branch and to a current mirror comprising a second transistor of the fifth branch and a third transistor of the sixth branch;

said sixth circuit branch, connected between Vdd voltage and ground, comprising:

said first transistor of the sixth branch connected to a gate of said second transistor of the startup circuit and to said second transistor of the sixth branch;

said second transistor of the sixth branch connected to said third transistor of the sixth branch and to a cathode of said first diode of the startup circuit; and said third transistor of the sixth branch; and said seventh branch, connected between Vdd voltage and said second transistor of the startup circuit, comprising said first transistor of the seventh branch, which is connected to a source of said second transistor of the startup circuit.

16. The circuit of claim 11 wherein said bandgap voltage reference generator is a voltage-mode bandgap voltage reference generator.

17. The circuit of claim 11 wherein said bandgap voltage reference generator is a current-mode bandgap voltage reference generator.

* * * * *